US005852758A

United States Patent [19]

Wibbels

[11] Patent Number: 5,852,758

[45] Date of Patent: Dec. 22, 1998

[54] CHARGE ROLLER DISPLACEMENT MECHANISM

[75] Inventor: Mark Wibbels, Boise, Id.

[73] Assignee: Hewlett-Packard Company, Palo Alto, Calif.

[21] Appl. No.: 25,993

[22] Filed: Feb. 19, 1998

[51] Int. Cl.[6] ..... G03G 15/02; G03G 21/00

[52] U.S. Cl. ..... 399/176; 399/100

[58] Field of Search ..... 399/100, 101, 399/176

[56] References Cited

U.S. PATENT DOCUMENTS 5,570,160 10/1996 Miwa et al. ..... 399/116

FOREIGN PATENT DOCUMENTS 7-110613 4/1995 Japan .
8-62933 3/1996 Japan .
9-134056 5/1997 Japan .

*Primary Examiner*—Joan Pendegrass
*Attorney, Agent, or Firm*—Gregg W. Wisdom

[57] ABSTRACT

A charge roller displacement mechanism prevents the build up of a sharply defined circumferential ring of contaminants on the surface of a charge roller in an electrophotographic printing system, thereby reducing the severity of the print defect caused by the contaminants. By cyclically laterally displacing the charge roller parallel to the longitudinal axis of a photoconductor drum as the photoconductor drum rotates, contaminants which reach the surface of the charge roller will not form a sharply defined circumferential ring that interferes with the uniform charging of a photoconductor drum charged by the charge roller. The charge roller displacement mechanism includes a first gear that engages the gear used to rotate paddles in a waste hopper of an electrophotographic printer cartridge. A second gear engages the first gear to provide a reduction of approximately 400 to 1. The charge roller is forced against a face of the second gear by a spring or, alternatively, by angling the longitudinal axis of the charge roller with respect to the longitudinal axis of the photoconductor drum. The face of the second gear contacting the charge roller includes a lobe. As the second gear rotates, the charge roller is laterally displaced across the surface of the photoconductor drum. The lobe is shaped so that one rotation of the second gear corresponds to one cycle of displacement of the charge roller.

20 Claims, 3 Drawing Sheets

CHARGE ROLLER DISPLACEMENT MECHANISM

FIELD OF THE INVENTION

This invention relates to electrophotographic printing systems, and more particularly to an apparatus which reduces the effect of contamination on a charge roller used in the electrophotographic printing system.

BACKGROUND OF THE INVENTION

Electrophotographic printing systems, such as photocopiers and electrophotographic printers, commonly use charge rollers for charging the surface of a photoconductor. The charged surface of the photoconductor is subsequently selectively discharged to form the latent electrostatic image onto which toner is developed. To achieve high print quality, it is important that the charge is deposited on the surface of the photoconductor so that a highly uniform surface potential results. Problems in the charging process which prevent uniform charging of areas on the surface of the photoconductor interfere with the development of toner onto areas of the photoconductor. The effects of non-uniform charging of the photoconductor surface are particularly visible in gray scale printing.

Contamination on the surface of the charge roller can contribute to non-uniform charging of the photoconductor surface. The charge roller is in rolling contact with the surface of the photoconductor during the electrophotographic printing process. Throughout the life of the electrophotographic printing system, the charge roller and the photoconductor maintain their relative positions with respect to the longest dimension of both the charge roller and the photoconductor. Because of this, contamination which reaches the charge roller in the same location along its length over the course of many printed pages can result in the buildup of a sharply defined circumferential ring on the charge roller. This ring of contaminants can act as a dielectric preventing proper charging of the corresponding area on the surface of the photoconductor. The improper charging of the photoconductor surface results in a visible print defect.

Attempts have been made to prevent the occurrence of this type of print defect. A first method involved the use of cleaning pads located in contact with the surface of the charge roller. The cleaning pads are formed from an abrasive material so that they scrub the surface of the charge roller to remove contaminants. Because of the abrasiveness of the cleaning pads, the outer layer of the charge roller must be made of a material that can withstand the abrasive action of the cleaning pads and which has the electrical characteristics necessary for allowing the charge roller to effectively charge the photoconductor. This limits the materials available for use on the charge roller outer layer, thereby raising the cost, and inevitably causing a reduction in the useful life of the charge roller as a result of the abrasion from the cleaning pad. Additionally, non-uniform abrasive characteristics of the cleaning pad can result in damage to the surface of the charge roller resulting in print defects.

A second method to prevent charge roller contamination print defects involves the addition of cleaning mechanisms to prevent contamination from reaching the charge roller. Such things as improved photoconductor cleaning blades, systems for photoconductor discharge, and cleaning mechanisms located in the print media path prior to the charge roller can be used to prevent contamination from reaching the charge roller. However, these mechanisms are costly to implement and are restricted by other limitations in the electrophotographic printing system.

Electrophotographic printers frequently use electrophotographic printer cartridges. Generally, the system components which require periodic replacement because of wear, such as the photoconductor and charge roller, are included within the electrophotographic print cartridge. A third method for preventing charge roller contamination print defects involves reducing the toner supply in the electrophotographic print cartridge to a level such that the toner will be consumed prior to the occurrence of charge roller contamination related print defects. However, this approach may substantially increase the cost per page printed. A need exists for an apparatus which prevents the occurrence of charge roller contamination related print defects without adding substantially to the cost of the electrophotographic printing system and without significantly reducing the life of the charge roller.

SUMMARY OF THE INVENTION

Accordingly, a charge roller displacement mechanism prevents the build up of a sharply defined circumferential ring of contaminants on the surface of a charge roller, thereby reducing the severity of print defects related to non-uniform charging of a photoconductor in an electrophotographic printing system. An embodiment of the charge roller displacement mechanism for laterally displacing the charge roller relative to the photoconductor in the electrophotographic printing system includes a first gear having a first plurality of teeth and having a first face with at least one lobe for contacting the charge roller. The rotation of the first gear laterally displaces the charge roller relative to the photoconductor as the charge roller rotates, thereby preventing contaminants from forming a sharply defined circumferential ring of contaminants on the surface of the charge roller.

An electrophotographic print cartridge designed for preventing the build up of a sharply defined circumferential ring of contaminants on the charge roller includes a charge roller having a first end and a second end. The electrophotographic print cartridge further includes a charge roller displacement mechanism contacting the first end of the charge roller for laterally displacing the charge roller as the charge roller rotates. Lateral displacement of the charge roller during its rotation prevents the buildup of a sharply defined circumferential ring of contaminants on the surface of the charge roller.

An electrophotographic printing system designed for preventing the build up of a sharply defined circumferential ring of contaminants on the charge roller includes a photoconductor and a charge roller having a first end and a second end. The charge roller contacts the photoconductor. The electrophotographic printing system further includes a charge roller displacement mechanism contacting the charge roller for laterally displacing the charge roller with respect to the photoconductor to prevent the buildup of a sharply defined circumferential ring of contaminants.

An electrophotographic printing system employing a photoconductor, a charge roller contacting the photoconductor, and a charge roller displacement mechanism contacting the charge roller is designed for reducing the severity of print defects resulting from the buildup of a circumferential ring of contaminants on the charge roller. A method for reducing the severity of print defects resulting from the charge roller contamination using the electrophotographic printing system includes the step of laterally displacing the charge roller during the rotation of the charge roller. The lateral displacement of the charge roller during rotation prevents the development of a circumferential ring of contamination on the charge roller, thereby reducing the severity of print defects related to charge roller contamination.

DESCRIPTION OF THE DRAWINGS

A more thorough understanding of the invention may be had from the consideration of the following detailed description taken in conjunction with the accompanying drawings in which.

DETAILED DESCRIPTION OF THE DRAWINGS

The present invention is not limited to the specific exemplary embodiments illustrated herein. Although the description of the preferred embodiment of the charge roller displacement mechanism will be provided in the context of an electrophotographic printer, one of ordinary skill in the art will recognize from understanding this disclosure that the charge roller displacement mechanism is applicable for other electrophotographic printing systems using charge rollers, such as electrophotographic copiers.

Figure 1:
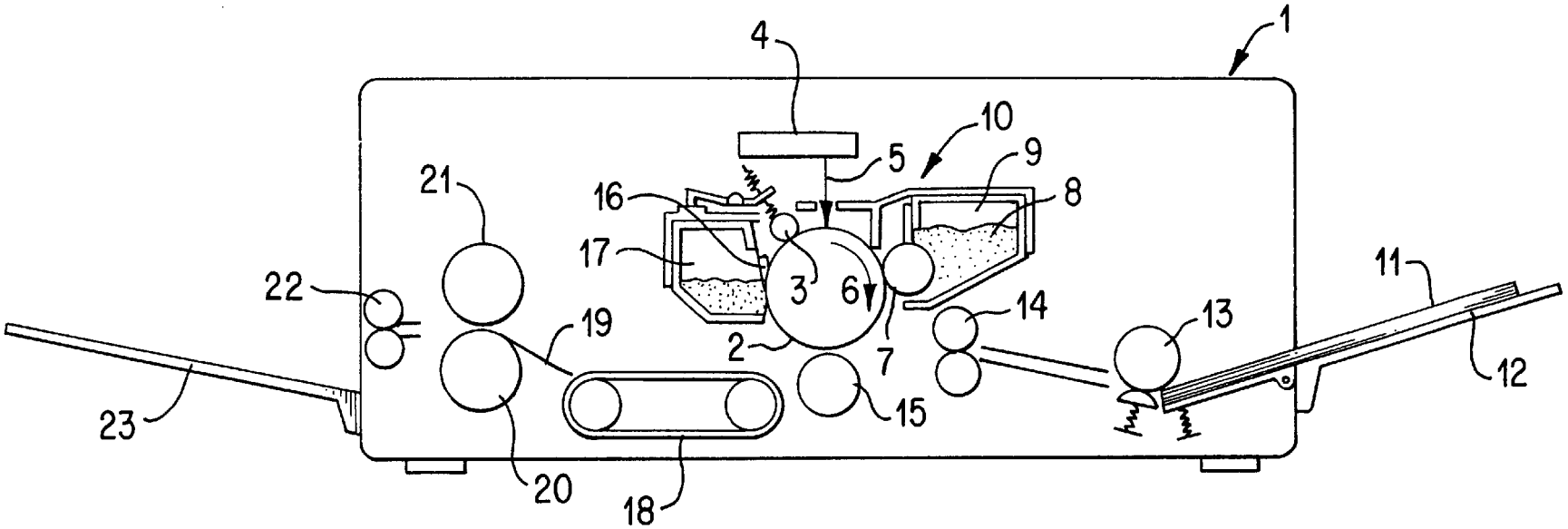
FIG. 1 is a simplified cross sectional view of an electrophotographic printer containing an embodiment of the charge roller displacement mechanism

Referring to FIG. 1, shown is a simplified cross sectional view of an exemplary electrophotographic printer 1 containing a photoconductor drum 2 and having a charge roller 3 using an embodiment of the charge roller displacement mechanism (not shown in FIG. 1) for the purposes of describing the electrophotographic printing process. Charge roller 3 is used to charge the surface of photoconductor drum 2 to a predetermined voltage. A laser diode (not shown) inside laser scanner 4 emits a laser beam 5 which is pulsed on and off as it is swept across the surface of photoconductor drum 2 to selectively discharge the surface of the photoconductor drum 2. Photoconductor drum 2 rotates in the clockwise direction as shown by the arrow 6. Developer roller 7 is used to develop the latent electrostatic image residing on the surface of photoconductor drum 2 after the surface voltage of the photoconductor drum 2 has been selectively discharged. Toner 8 which is stored in the toner hopper 9 of electrophotographic print cartridge 10 moves from locations within the toner hopper 9 to the developer roller 7. The magnet located within the developer roller 7 magnetically attracts the toner 8 to the surface of the developer roller 7. As the developer roller 7 rotates in the counterclockwise direction, the toner on the surface of the developer roller 7, located opposite the areas on the surface of photoconductor drum 2 which are discharged, is moved across the gap between the surface of the photoconductor drum 2 and the surface of the developer roller 7 to develop the latent electrostatic image.

Print media 11 is loaded from paper tray 12 by pickup roller 13 into the paper path of the electrophotographic printer 1. Print media 11 moves through the drive rollers 14 so that the arrival of the leading edge of print media 11 below photoconductor drum 2 is synchronized with the rotation of the region on the surface of photoconductor drum 2 having a latent electrostatic image corresponding to the leading edge of print media 11. As the photoconductor drum 2 continues to rotate in the clockwise direction, the surface of the photoconductor drum 2, having toner 8 adhered to it in the discharged areas, contacts the print media 11 which has been charged by transfer roller 15 so that it attracts the toner particles away from the surface of the photoconductor drum 2 and onto the surface of the print media 11. The transfer of toner particles from the surface of photoconductor drum 2 to the surface of the print media 11 does not occur with one hundred percent efficiency and therefore some toner particles remain on the surface of photoconductor drum 2. As photoconductor drum 2 continues to rotate, toner particles which remain adhered to its surface are removed by cleaning blade 16 and deposited in toner waste hopper 17.

As the print media 11 moves in the paper path past photoconductor drum 2, conveyer belt 18 delivers the print media 11 up inlet guide 19 to fuser 20. The print media 11 passes between the fuser 20 and the pressure roller 21. Pressure roller 21 provides the drive force to pull print media 11 over fuser 20 and forces print media 11 against the surface of fuser 20. Fuser 20 applies heat to print media 11 so that the toner particles are fused to the surface of print media 11. Output rollers 22 push the print media 11 into the output tray 23 after exiting the fusing operation. Further details on electrophotographic processes can be found in the text "The Physics and Technology of Xerographic Processes", by Edgar M. Williams, 1984, a Wiley-Interscience Publication of John Wiley & Sons, the disclosure of which is incorporated by reference herein.

Figure 2:
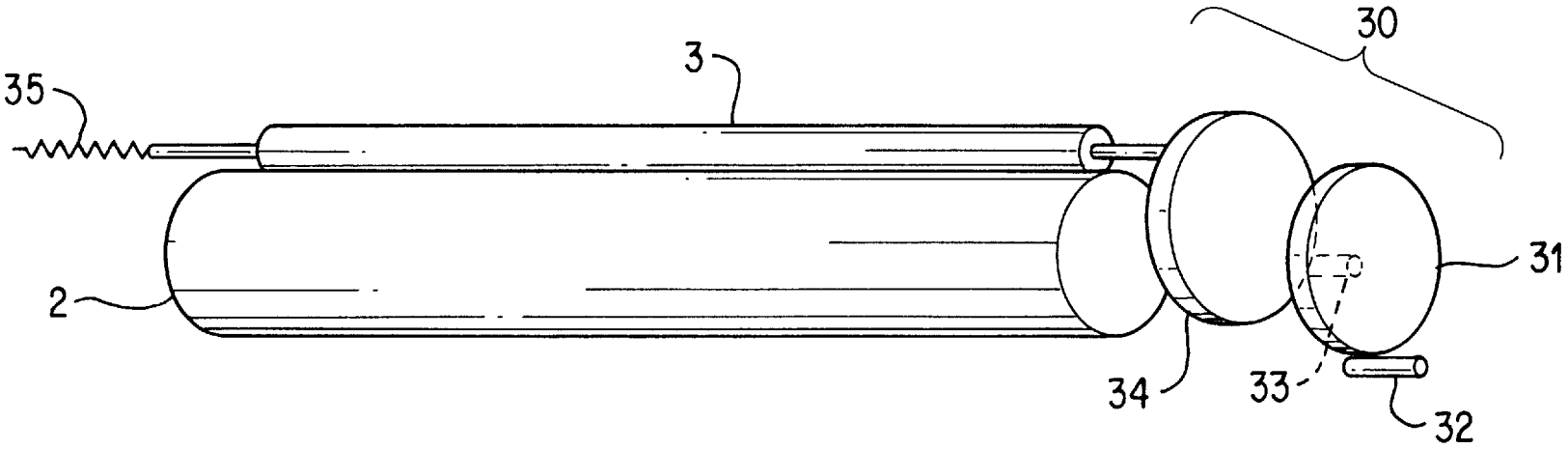
FIG. 2 is a simplified drawing of an embodiment of the charge roller displacement mechanism.

Shown in FIG. 2 is an embodiment of the charge roller displacement mechanism 30. For simplicity of illustration, the gear teeth on the gears included in the charge roller displacement mechanism 30 are not shown. The charge roller displacement mechanism 30 includes a first gear 31 which engages the electrophotographic print cartridge gear 32. In this embodiment of charge roller displacement mechanism 30, electrophotographic print cartridge gear 32 is also used to rotate paddles in the toner waste hopper 17. It should be recognized that other gears in electrophotographic print cartridge 10 may be used to drive charge roller displacement mechanism 30. The charge roller displacement mechanism 30 further includes a second gear 33 attached to first gear 31. A third gear 34 engages second gear 33.

The gearing ratio provides a reduction of approximately 400 to 1 from the electrophotographic print cartridge gear 32 to third gear 34. The term "approximately", as it is used in this specification to refer to the gear ratio, means a gear ratio within 10% of 400. It should be recognized that larger gear reduction ratios could be used. Furthermore, smaller gear reduction ratios may be used with the constraint that the period of the lateral charge roller displacement must be sufficiently long with respect to the rotational period of photoconductor drum 2 so that the forces exerted on photoconductor drum 2 by the displacement of charge roller 3 do not cause mis-registration. Additionally, if a sufficiently large gear reduction ratio could be achieved between the electrophotographic print cartridge gear 32 and third gear 34, it would be possible to use only third gear 34 in charge roller displacement mechanism 30.

Third gear 34 includes a face for contacting charge roller 3. The face of third gear 34 contacting charge roller 3 includes a lobe for displacing charge roller 3 as third gear 34 rotates. The end of charge roller 3 contacting third gear 34 is loaded by spring 35 against the lobe on third gear 34. Alternatively, charge roller 3 could be loaded against the lobe of third gear 34 by slightly angling the axis of charge roller 3 with respect to the axis of photoconductor drum 2. This implementation would not require the use of spring 35 to load charge roller 3 against the lobe on third gear 34.

Figure 3:
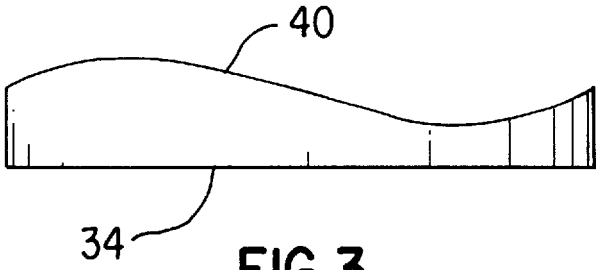
FIG. 3 is a side view drawing of a gear used in an embodiment of the charge roller displacement mechanism.

Shown in FIG. 3 is a view of third gear 34 showing lobe 40. As third gear 34 slowly rotates (relative to the rotation rate of photoconductor drum 2) charge roller 3 is laterally displaced parallel to the axis of photoconductor drum 2. Lobe 40 is sized so that the total lateral displacement of charge roller 3 is approximately 0.1875 inches. Furthermore, lobe 40 is distributed on the face of third gear 34 so that over the course of one rotation of third gear 34, charge roller 3 moves through one cycle of displacement. That is, charge roller 3 is laterally displaced approximately 0.1875 inches and returns to its initial position at the completion of the rotation. The lateral displacement of charge roller 3 prevents the development of a sharply defined circumferential ring of contamination around charge roller 3, thereby allowing charge roller 3 to more uniformly charge the surface of photoconductor drum 2. Through the reciprocating movement of charge roller 3, the contamination is spread over the surface of the charge roller, preventing a large reduction in the charging in a particular location. By providing such a large gear reduction in charge roller displacement mechanism 30, the rate at which charge roller 3 moves across the surface of photoconductor 2 is much lower than the rotational rate of photoconductor drum 2. Because of the difference in these velocities, the lateral force imparted to photoconductor drum 2 resulting from the lateral movement of charge roller 3 does not cause mis-registration of photoconductor drum 2. The simplicity of charge roller displacement mechanism 30 permits a low cost implementation with little impact upon the rest of the electrophotographic printing system.

Although several embodiments of the invention have been illustrated, and their forms described, it is readily apparent to those of ordinary skill in the art that various modifications may be made therein without departing from the spirit of the invention or from the scope of the appended claims.

What is claimed is:

1. A charge roller displacement mechanism for laterally displacing a charge roller relative to a photoconductor in an electrophotographic printing system, the charge roller displacement mechanism comprising:

a first gear having a first plurality of teeth and having a first face with at least one lobe for contacting the charge roller, where rotation of the first gear laterally displaces the charge roller relative to the photoconductor, the charge roller includes a longitudinal axis and the photoconductor includes a longitudinal axis with the charge roller positioned to angle the longitudinal axis of the charge roller with respect to the longitudinal axis of the photoconductor for loading the charge roller against the first face of the first gear during rotation of the photoconductor and the charge roller.

2. The charge roller displacement mechanism as recited in claim 1, further comprising:

a second gear having a second plurality of teeth engaging the first plurality of teeth of the first gear; and a third gear having a third plurality of teeth with the third gear attached to the second gear.

3. The charge roller displacement mechanism as recited in claim 2, wherein:

the second gear includes a second face and the third gear includes a third face which concentrically attaches to the second face of the second gear.

4. The charge roller displacement mechanism as recited in claim 3, wherein:

the lobe of the first face of the first gear includes a shape for laterally displacing the charge roller through one cycle over one revolution of the first gear; and the third gear engages a fourth gear, with the first plurality, the second plurality, and the third plurality of teeth each including a number of gear teeth so that one revolution of the first gear requires approximately 400 revolutions of the fourth gear.

5. An electrophotographic print cartridge, comprising:

a charge roller having a first end, a second end, and a longitudinal axis;

a photoconductor contacting the charge roller and having a longitudinal axis;

a charge roller displacement mechanism contacting the first end of the charge roller for laterally displacing the charge roller with the charge roller positioned to angle the longitudinal axis of the charge roller with respect to the longitudinal axis of the photoconductor for loading the first end of the charge roller against the charge roller displacement mechanism during rotation of the photoconductor and the charge roller.

6. The electrophotographic print cartridge as recited in claim 5, wherein:

the charge roller displacement mechanism includes a first gear having a first plurality of teeth and having a first face with at least one lobe contacting the first end of the charge roller so that rotation of the first gear laterally displaces the charge roller, a second gear having a second plurality of teeth engaging the first plurality of teeth of the first gear, and a third gear having a third plurality of teeth with the third gear attached to the second gear.

7. The electrophotographic print cartridge as recited in claim 6, wherein:

the second gear includes a second face and the third gear includes a third face which concentrically attaches to the second face of the second gear; and the lobe of the first face of the first gear includes a shape for laterally displacing the charge roller through one cycle over one revolution of the first gear.

8. The electrophotographic print cartridge as recited in claim 7, further comprising:

a fourth gear having a fourth plurality of teeth engaging the third plurality of teeth of the third gear, with the first plurality, the second plurality, and the third plurality of teeth each including a number of gear teeth so that one revolution of the first gear requires approximately 400 revolutions of the fourth gear.

9. The electrophotographic print cartridge as recited in claim 8, further comprising:

a photoconductor drum contacting the charge roller where the photoconductor drum and the charge roller each include a longitudinal axis with the longitudinal axis of the charge roller angled with respect to the longitudinal axis of the photoconductor drum.

10. The electrophotographic print cartridge as recited in claim 8, further comprising:

a spring contacting the second end of the charge roller.

11. The electrophotographic print cartridge as recited in claim 8, wherein:

the fourth gear drives a stirring paddle in a waste toner hopper in the electrophotographic print cartridge.

12. An electrophotographic printing system, comprising:

a charge roller having a longitudinal axis;

a charge roller displacement mechanism contacting the charge roller for laterally displacing the charge roller and;

a photoconductor contacting the charge roller, the photoconductor having a longitudinal axis with the longitudinal axis of the charge roller angled with respect to the longitudinal axis of the photoconductor for loading the charge roller against the charge roller displacement mechanism during rotation of the photoconductor and the charge roller.

13. The electrophotographic printing system, as recited in claim 12, wherein:

the charge roller includes a first end and a second end; and the charge roller displacement mechanism includes a first gear having a first plurality of teeth, with the first gear having a first face with at least one lobe that contacts the first end of the charge roller so that rotation of the first gear laterally displaces the charge roller relative to the photoconductor, a second gear having a second plurality of teeth engaging the first plurality of teeth of the first gear, and a third gear having a third plurality of teeth with the third gear attached to the second gear.

14. The electrophotographic printing system as recited in claim 13, wherein:

the second gear includes a second face and the third gear includes a third face which concentrically attaches to the second face of the second gear.

15. The electrophotographic printing system as recited in claim 14, wherein:

the photoconductor includes a photoconductor drum where the photoconductor drum and the charge roller each have a longitudinal axis with the longitudinal axis of the charge roller angled with respect to the longitudinal axis of the photoconductor drum.

16. The electrophotographic printing system as recited in claim 14, further comprising:

a spring contacting the second end of the charge roller.

17. The electrophotographic printing system as recited in claim 14, wherein:

the lobe of the first face of the first gear includes a shape for laterally displacing the charge roller through one cycle over one revolution of the first gear.

18. The electrophotographic printing system as recited in claim 17, further comprising:

a fourth gear having a fourth plurality of teeth engaging the third plurality of teeth of the third gear, with the first plurality, the second plurality, and the third plurality of teeth each including a number of gear teeth so that one revolution of the first gear requires approximately 400 revolutions of the fourth gear.

19. In an electrophotographic printing system employing a photoconductor having a longitudinal axis, a charge roller having a longitudinal axis and contacting the photoconductor, and a charge roller displacement mechanism contacting the charge roller, a method for reducing the severity of print defects resulting from charge roller contamination comprising the steps of:

angling the longitudinal axis of the charge roller with respect to the longitudinal axis of the photoconductor to load the charge roller against the charge roller displacement mechanism; and laterally displacing the charge roller during the rotation of the charge roller to prevent the development of a circumferential ring of contamination on the charge roller.

20. The method as recited in claim 19, wherein:

the step of laterally displacing the charge roller includes laterally displacing the charge roller cyclically.

* * * * *